US011274448B1

(12) United States Patent
Horstmyer

(10) Patent No.: US 11,274,448 B1
(45) Date of Patent: Mar. 15, 2022

(54) RAIN IRRIGATION ASSEMBLY

(71) Applicant: Stephen Horstmyer, Cazenovia, NY (US)

(72) Inventor: Stephen Horstmyer, Cazenovia, NY (US)

( * ) Notice: Subject to any disclaimer, the term of this patent is extended or adjusted under 35 U.S.C. 154(b) by 0 days.

(21) Appl. No.: 17/064,294

(22) Filed: Oct. 6, 2020

(51) Int. Cl.
*E04D 13/08* (2006.01)

(52) U.S. Cl.
CPC ..... *E04D 13/08* (2013.01); *E04D 2013/082* (2013.01); *E04D 2013/0813* (2013.01); *E04D 2013/0846* (2013.01)

(58) Field of Classification Search
CPC ..... E04D 13/08; E04D 2013/0813; E04D 2013/082; E04D 2013/0846; E04D 2013/0873; A01G 25/02; E03B 3/02; Y02A 20/00; Y02A 20/108; Y10T 137/6966; Y10T 137/6969
See application file for complete search history.

(56) References Cited

U.S. PATENT DOCUMENTS 2,814,529 A * 11/1957 Arnt ..... B05B 1/20 239/208
2,966,171 A * 12/1960 Kotlar ..... E04D 13/08 137/561 R
3,035,779 A * 5/1962 Convis ..... E04D 13/08 239/208
3,429,125 A * 2/1969 Shotton ..... E02B 13/00 405/45
3,902,273 A * 9/1975 Friedman ..... A01G 7/00 47/58.1 R
3,904,121 A * 9/1975 Geagan ..... B05B 1/14 239/208
4,161,186 A * 7/1979 Sitarz ..... E04D 13/08 137/356
4,620,817 A * 11/1986 Cushing ..... C02F 3/046 435/43
4,934,404 A * 6/1990 DeStefano ..... E03B 3/03 137/357
5,220,755 A * 6/1993 Roles ..... E04D 13/08 52/16
5,533,303 A 7/1996 Harvey
5,730,179 A * 3/1998 Taylor ..... E04D 13/08 137/357
5,735,304 A * 4/1998 Chumley ..... E03B 3/02 137/15.01
5,862,632 A * 1/1999 Zima ..... E04D 13/08 52/16
5,931,118 A * 8/1999 Thompson ..... A01K 45/002 119/69.5
6,941,702 B1 * 9/2005 Abrams ..... E03B 1/041 52/16

(Continued)

*Primary Examiner* — James M Ference

(57) ABSTRACT

A rain irrigation assembly includes a collector that is insertable into a downspout of a rain gutter to collect rain running in the downspout. A plurality of hoses is each fluidly coupled to the collector to receive the rain from the collector. A plurality of watering units is provided and each of the watering units can be positioned at a selected area of a yard. Each of the watering units is fluidly coupled to a respective one of the hoses to receive the rain from the respective hose. Each of the watering units has a foraminous surface to pass the rain outwardly therefrom for irrigating the selected area of the yard.

5 Claims, 4 Drawing Sheets

(56) References Cited

U.S. PATENT DOCUMENTS 7,052,212 B1 * 5/2006 Joyner ..... E04D 13/08 405/119
8,496,810 B2 * 7/2013 Forrest ..... E03B 3/03 210/162
8,528,263 B2 9/2013 Schmidt
8,578,976 B1 * 11/2013 Davis ..... E03B 3/03 141/86
8,925,575 B1 * 1/2015 Taborek ..... E03B 3/03 137/357
9,988,817 B2 6/2018 Johnson
10,472,830 B1 * 11/2019 Middleton ..... E03B 3/02
2008/0092958 A1 * 4/2008 Dwyer ..... E04D 13/08 137/118.01
2009/0031625 A1 * 2/2009 McAvoy ..... A01G 25/00 47/48.5
2009/0050215 A1 * 2/2009 Hayes ..... E04D 13/08 137/357
2009/0065072 A1 * 3/2009 Adamson ..... E03B 3/02 137/357
2009/0229689 A1 9/2009 Booth
2010/0193046 A1 * 8/2010 Moroder ..... F16L 55/24 137/357
2010/0199574 A1 8/2010 Perlatti
2011/0005602 A1 * 1/2011 Harrington ..... E03B 1/04 137/1
2011/0315610 A1 12/2011 Graf
2012/0247580 A1 10/2012 Guinyard
2012/0279583 A1 11/2012 Forrest
2013/0233443 A1 * 9/2013 Kuehneman ..... F16L 55/24 141/69
2015/0050087 A1 * 2/2015 Gould ..... F16L 9/14 405/36
2015/0156975 A1 * 6/2015 Gould ..... B29C 65/08 239/565
2015/0247299 A1 * 9/2015 McDowell ..... E03B 1/04 405/52
2016/0102446 A1 * 4/2016 Brucker ..... E03B 3/03 137/15.01
2016/0212944 A1 * 7/2016 Holby ..... A01G 9/02
2018/0080229 A1 3/2018 Kunz
2018/0206420 A1 * 7/2018 Kendall ..... A01G 25/00
2018/0274240 A1 9/2018 Kilbert

* cited by examiner

RAIN IRRIGATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to irrigation devices and more particularly pertains to a new irrigation device for routing rain from a downspout to a plurality of selected locations for the purposes of irrigation.

(2) Description of Related Art Including Information Disclosed Under 37 CFR 1.97 and 1.98

The prior art relates to irrigation devices including a downspout irrigation device that including an irrigation pipe that is attached between downspouts of a building to irrigate next to the building. The prior art discloses a variety of downspout diversion devices for diverting rain water from a downspout. The prior art discloses a downspout sprinkler device that includes a collector that is insertable into a downspout, a hose coupled to the collector and a foraminous sprinkler for irrigating with rain water collected from the downspout.

BRIEF SUMMARY OF THE INVENTION

An embodiment of the disclosure meets the needs presented above by generally comprising a collector that is insertable into a downspout of a rain gutter to collect rain running in the downspout. A plurality of hoses is each fluidly coupled to the collector to receive the rain from the collector. A plurality of watering units is provided and each of the watering units can be positioned at a selected area of a yard. Each of the watering units is fluidly coupled to a respective one of the hoses to receive the rain from the respective hose.

Each of the watering units has a foraminous surface to pass the rain outwardly therefrom for irrigating the selected area of the yard.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
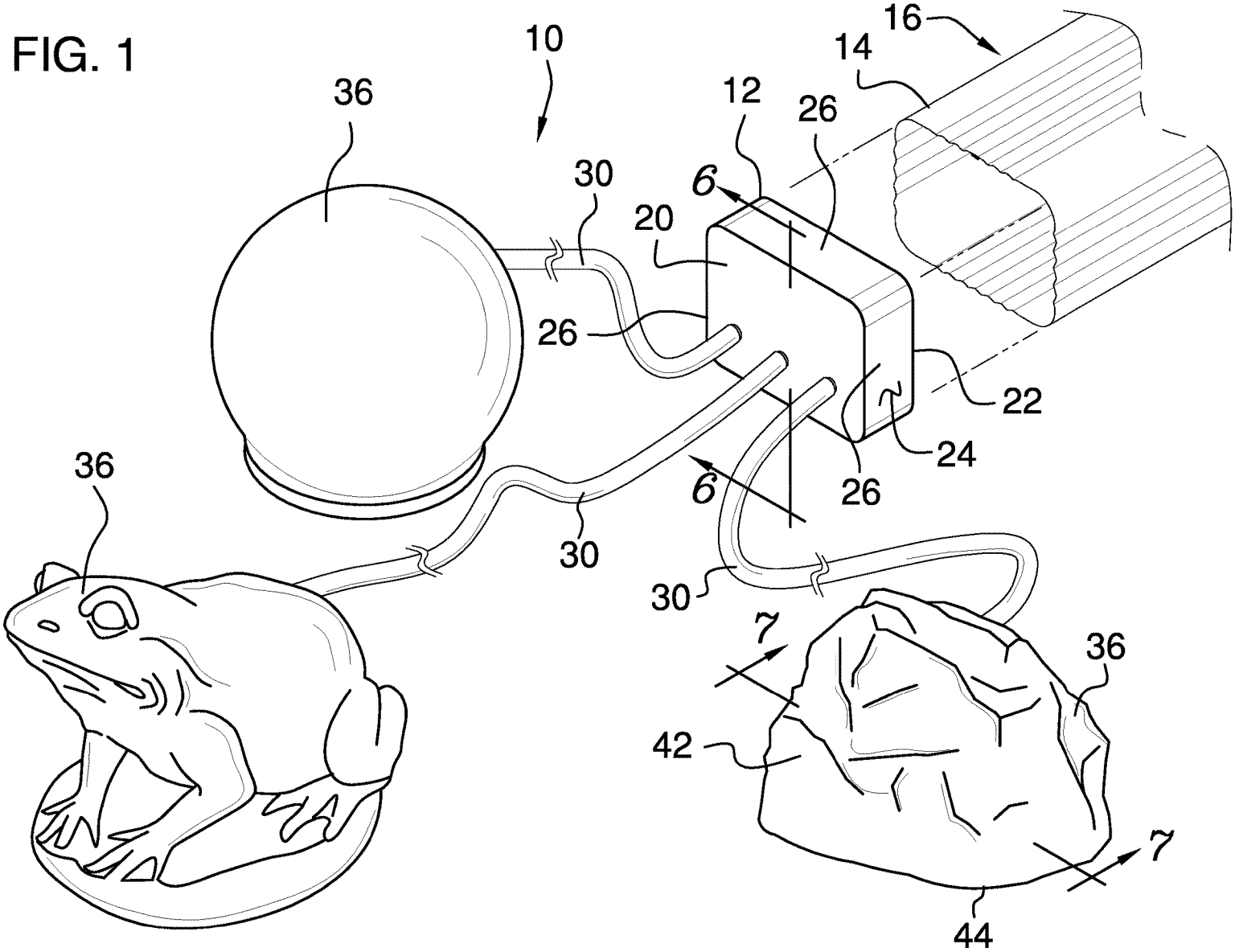
FIG. 1 is a perspective view of a rain irrigation assembly according to an embodiment of the disclosure.
Figure 3:
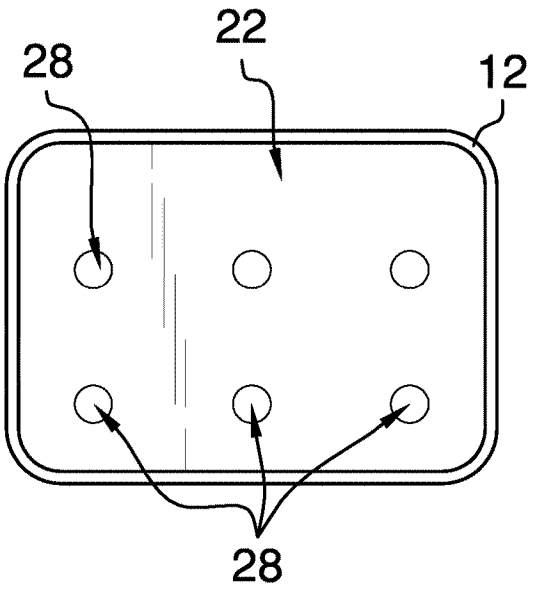
FIG. 3 is a back view of a collector of an embodiment of the disclosure.
Figure 2:
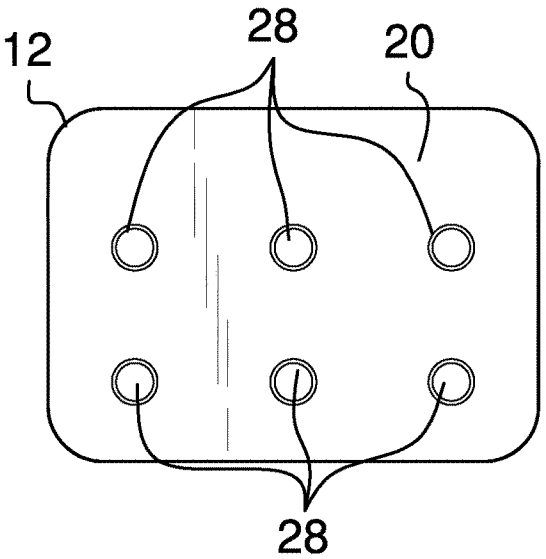
FIG. 2 is a front view of collector of an embodiment of the disclosure.
Figure 4:
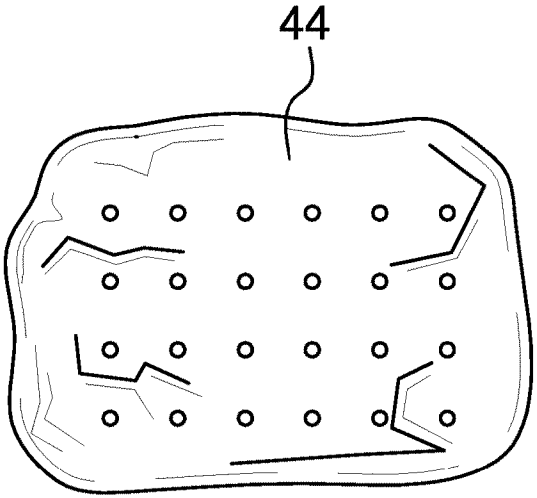
FIG. 4 is a bottom view of a watering unit of an embodiment of the disclosure.
Figure 5:
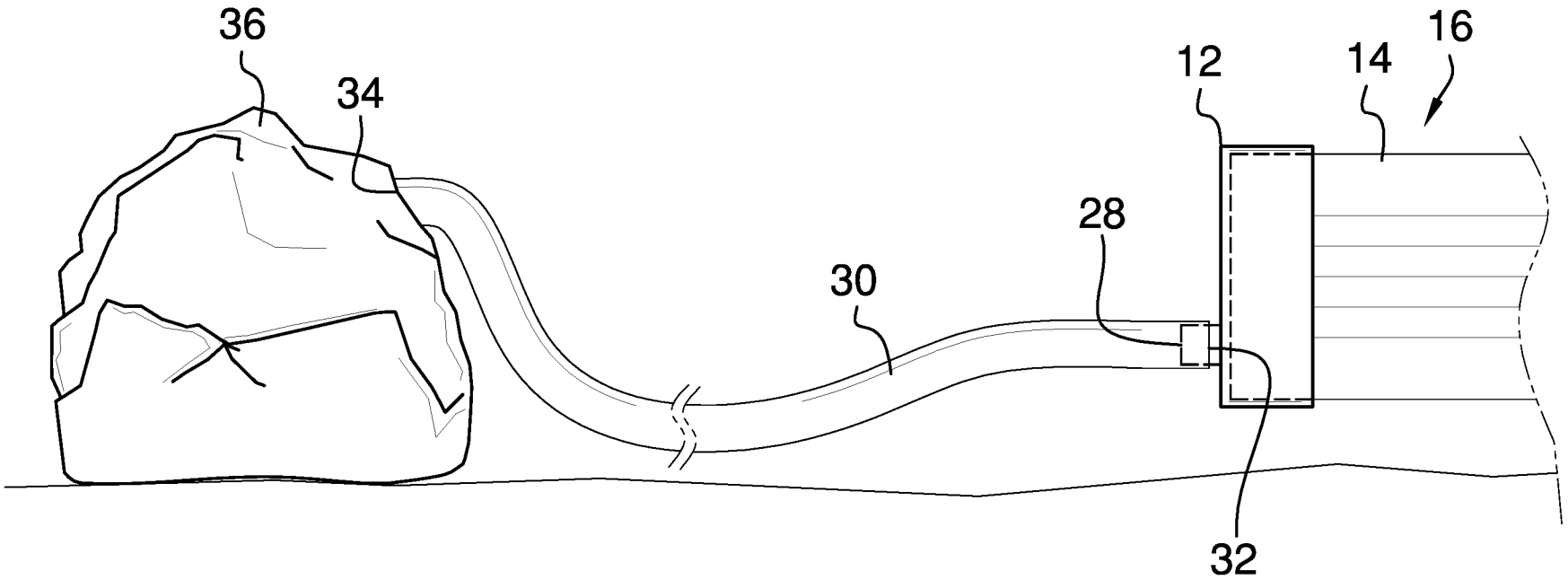
FIG. 5 is a perspective in-use view of an embodiment of the disclosure.
Figure 7:
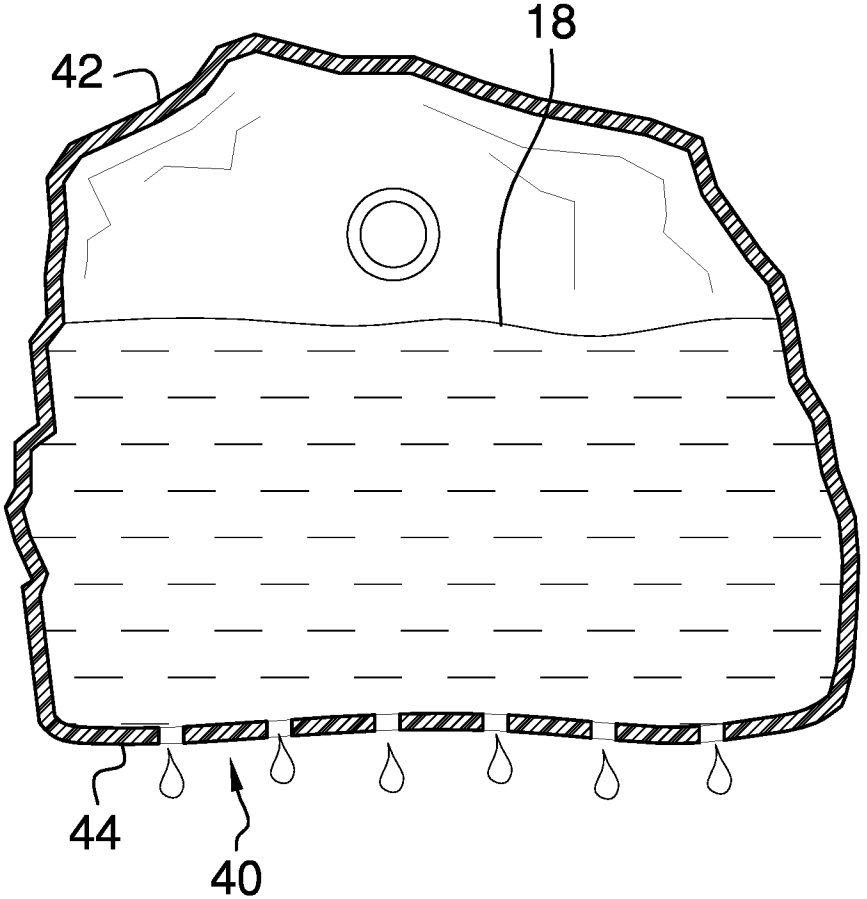
FIG. 7 is a cross sectional view taken along line 7-7 of FIG. 1 of an embodiment of the disclosure.
Figure 6:
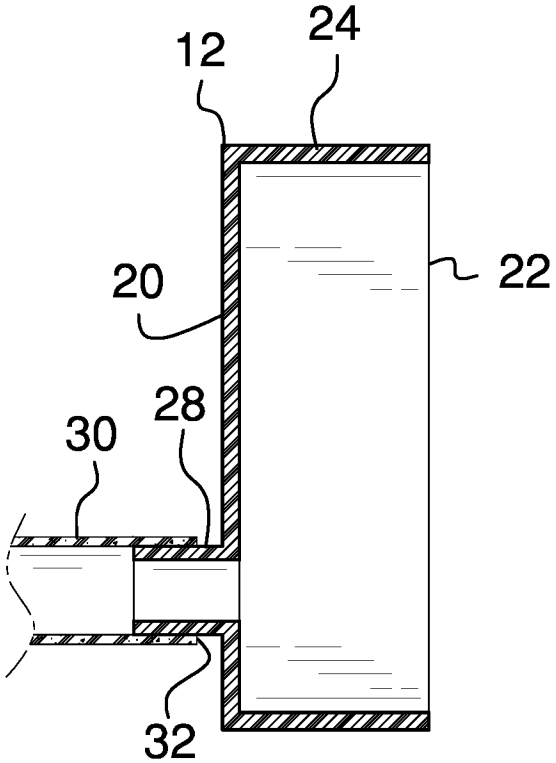
FIG. 6 is a cross sectional view taken along line 6-6 of FIG. 1 of an embodiment of the disclosure.

With reference now to the drawings, and in particular to FIGS. 1 through 7 thereof, a new irrigation device embodying the principles and concepts of an embodiment of the disclosure and generally designated by the reference numeral 10 will be described.

As best illustrated in FIGS. 1 through 7, the rain irrigation assembly 10 generally comprises a collector 12 that is insertable into a downspout 14 of a rain gutter 16 to collect rain 18 running in the downspout 14. The rain gutter 16 may be a rain gutter of any conventional design that is attached to a building for collecting rain 18. The collector 12 has a front side 20, a back side 22 and a perimeter surface 24 extending therebetween. The perimeter surface 24 has a plurality of intersecting sides 26 such that the collector 12 has a rectangular shape thereby facilitating the collector 12 to snugly fit into the downspout 14.

The back side 22 is open to collect the rain 18 from the downspout 14. The front side 20 has a plurality of output ports 28 each extending therethrough thereby facilitating the rain 18 to pass through each of the output ports 28. A plurality of hoses 30 is provided and each of the hoses 30 is fluidly coupled to the collector 12 to receive the rain 18 from the collector 12. Each of the hoses 30 has a first end 32 and a second end 34, and the first end 32 of each of the hoses 30 is fluidly coupled to a respective one of the output ports 28 for receiving the rain 18.

A plurality of watering units 36 is provided and each of the watering units 36 can be positioned at a selected area of a yard 38. Moreover, each of the watering units 36 is fluidly coupled to a respective one of the hoses 30 to receive the rain 18 from the respective hose 30. Each of the watering units 36 has a foraminous surface 40 to pass the rain 18 outwardly therefrom for irrigating the selected area of the yard 38. Each of the watering units 36 has an outer wall 42 and a basal wall 44 and the basal wall 44 of each of the watering units 36 is foraminous. In this way the basal wall 44 of each of the watering units 36 can release the rain 18 onto the ground in the selected area of yard 38. Each of the watering units 36 is hollow and the outer wall 42 the second end 34 of the respective hose 30 is fluidly coupled to the outer wall 42 for receiving the rain 18. The outer wall 42 of each of the watering units 36 is structured in a unique manner such that each of the watering units 36 has the ornamental appearance of a rock, an animal such as a frog, a ball or any other conceivable object.

In use, the collector 12 is inserted into the downspout 14 of the gutter and each of the hoses 30 is fluidly coupled to the respective output port. Each of the watering units 36 is positioned in the selected area of the yard 38. In this way the rain 18 that runs down the downspout 14 is routed to each of the watering units 36. Thus, the watering units 36 irrigate the selected area of the yard 38 for improving the appearance of the yard 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rain irrigation assembly for collecting rain from a downspout and distributing the rain to a chosen area for irrigation, said assembly comprising:

a collector being insertable into a downspout of a rain gutter wherein said collector is configured to collect rain running in the downspout;

a plurality of hoses, each of said hoses being fluidly coupled to said collector wherein each of said hoses is configured to receive the rain from said collector; and a plurality of watering units, each of said watering units being configured to be positioned at a selected area of a yard, each of said watering units being fluidly coupled to a respective one of said hoses wherein each of said watering units is configured to receive the rain from said respective hose, each of said watering units having a foraminous surface wherein said foraminous surface is configured to pass the rain outwardly therefrom for irrigating the selected area of the yard, wherein each of said watering units has an outer wall and a basal wall, said basal wall being arcuate wherein an outer surface of said basal wall is concave wherein an outer portion of said basal wall is configured to rest on the ground in the selected area of the yard, said basal wall of each of said watering units being foraminous wherein said basal wall is configured to release the rain onto the ground in the selected area of the yard.

2. The assembly according to claim 1, wherein said collector has a front side, a back side and a perimeter surface extending therebetween, said perimeter surface having a plurality of intersecting sides such that said collector has a rectangular shape thereby facilitating said collector to snugly fit into the downspout, said back side being open wherein said back side is configured to collect the rain from the downspout, said front side having a plurality of output ports each extending therethrough wherein each of said output ports is configured to have the rain pass therethrough.

3. The assembly according to claim 2, wherein each of said hoses has a first end and a second end, said first end of each of said hoses being fluidly coupled to a respective one of said output ports for receiving the rain.

4. The assembly according to claim 1, wherein:

each of said hoses has a first end and a second end; and each of said watering units is hollow, said outer wall of each of said watering units having said second end of said respective hose being fluidly coupled thereto for receiving the rain.

5. A rain irrigation assembly for collecting rain from a downspout and distributing the rain to a chosen area for irrigation, said assembly comprising:

a collector being insertable into a downspout of a rain gutter wherein said collector is configured to collect rain running in the downspout, said collector having a front side, a back side and a perimeter surface extending therebetween, said perimeter surface having a plurality of intersecting sides such that said collector has a rectangular shape thereby facilitating said collector to snugly fit into the downspout, said back side being open wherein said back side is configured to collect the rain from the downspout, said front side having a plurality of output ports each extending therethrough wherein each of said output ports is configured to have the rain pass therethrough;

a plurality of hoses, each of said hoses being fluidly coupled to said collector wherein each of said hoses is configured to receive the rain from said collector, each of said hoses having a first end and a second end, said first end of each of said hoses being fluidly coupled to a respective one of said output ports for receiving the rain; and a plurality of watering units, each of said watering units being configured to be positioned at a selected area of a yard, each of said watering units being fluidly coupled to a respective one of said hoses wherein each of said watering units is configured to receive the rain from said respective hose, each of said watering units having a foraminous surface wherein said foraminous surface is configured to pass the rain outwardly therefrom for irrigating the selected area of the yard, each of said watering units having an outer wall and a basal wall, said basal wall being arcuate wherein an outer surface of said basal wall is concave wherein an outer portion of said basal wall is configured to rest on the ground in the selected area of the yard, said basal wall of each of said watering units being foraminous wherein said basal wall is configured to release the rain onto the ground in the selected area of yard, said basal wall of each of said watering units being foraminous wherein said basal wall is configured to release the rain onto the ground in the selected area of the yard, each of said watering units being hollow, said outer wall of each of said watering units having said second end of said respective hose being fluidly coupled thereto for receiving the rain.

* * * * *